US007980362B2

(12) United States Patent
Kostka

(10) Patent No.: US 7,980,362 B2
(45) Date of Patent: Jul. 19, 2011

(54) SAFETY EQUIPMENT FOR PREVENTING AN ELEVATOR CAR COLLISION WITH AN OBJECT

(75) Inventor: Miroslav Kostka, Ballwil (CH)

(73) Assignee: Inventio AG, Hergiswil NW (CH)

( * ) Notice: Subject to any disclaimer, the term of this patent is extended or adjusted under 35 U.S.C. 154(b) by 861 days.

(21) Appl. No.: 11/848,536

(22) Filed: Aug. 31, 2007

(65) Prior Publication Data

US 2008/0053757 A1 Mar. 6, 2008

(30) Foreign Application Priority Data

Aug. 31, 2006 (EP) ..... 06119935

(51) Int. Cl.
*B66B 9/00* (2006.01)

(52) U.S. Cl. ..... 187/249; 187/391

(58) Field of Classification Search ..... 187/247, 187/249, 380–388, 391–394
See application file for complete search history.

(56) References Cited

U.S. PATENT DOCUMENTS

| | | | | |
|---|---|---|---|---|
| 5,151,562 | A * | 9/1992 | Fujita et al. | 187/394 |
| 5,663,538 | A * | 9/1997 | Sakita | 187/382 |
| 5,877,462 | A * | 3/1999 | Chenais | 187/249 |
| 6,079,521 | A | 6/2000 | Schoenauer et al. | |
| 6,253,879 | B1 * | 7/2001 | Skalski et al. | 187/287 |
| 6,554,107 | B2 * | 4/2003 | Yumura et al. | 187/247 |
| 7,178,635 | B2 * | 2/2007 | Meissner et al. | 187/249 |
| 7,779,967 | B2 * | 8/2010 | Kocher et al. | 187/249 |
| 7,819,228 | B2 * | 10/2010 | Terry et al. | 187/249 |
| 2003/0057030 | A1 | 3/2003 | Yumara | |
| 2007/0062763 | A1 * | 3/2007 | Shiratsuki et al. | 187/394 |

FOREIGN PATENT DOCUMENTS

| | | | |
|---|---|---|---|
| EP | 0 769 469 | A1 | 4/1997 |
| GB | 2 211 046 | A | 6/1989 |
| JP | 05132257 | A * | 5/1993 |
| WO | WO 2004/043841 | A1 | 5/2005 |

* cited by examiner

*Primary Examiner* — Jonathan Salata
(74) *Attorney, Agent, or Firm* — Fraser Clemens Martin & Miller LLC; William J. Clemens

(57) ABSTRACT

Safety equipment for an elevator installation with an upper elevator car and a lower elevator car, which cars are both movable substantially independently along a vertical direction in a common elevator shaft of the elevator installation includes a first electro-optical detection system with a first light source in a lower region of the upper elevator car and with a first detector which comprises a light-sensitive first sensor region in an upper region of the lower elevator car. The first light source issues a focused first light beam at a first angle with respect to the vertical direction. The first angle is predetermined such that on approach of the upper and the lower elevator cars the first light beam is incident on the first sensor region and thus is detectable by the first detector. In this case, the first detector triggers a reaction.

21 Claims, 3 Drawing Sheets

SAFETY EQUIPMENT FOR PREVENTING AN ELEVATOR CAR COLLISION WITH AN OBJECT

FIELD OF THE INVENTION

This invention relates to safety equipment for an elevator installation with at least one elevator car according to the introductory part of the independent claims. Moreover, the invention relates to a corresponding elevator installation.

BACKGROUND OF THE INVENTION

Elevator cars in a multi-mobile elevator installation are typically each equipped with an own drive and an own braking system. The electronic control of the overall elevator installation is frequently so designed that no collisions of the individual elevator cars should occur. In particular, in the case of an emergency stop or even in the case of a normal storey stop of an elevator car it cannot be guaranteed in all circumstances that a further elevator car disposed above or below in the same elevator shaft can still stop at the correct time in order to avoid a collision. This could be avoided in that sufficient spacings between the individual elevator cars and also appropriately adapted vertical speeds were predetermined by the control. However, due to such presetting the transport capacity of a multi-mobile elevator installation cannot be fully utilized, which has an influence on the cost/utilization efficiency.

A multi-mobile elevator installation is known from European Patent Specification EP 769 469 B1, which comprises means for opening the safety circuit of an elevator installation if there is an undesired approach to another elevator car. According to the patent specification safety modules which evaluate the car positions and speeds so as, in a given case, to be able to trigger braking processes even at other elevator cars, are present at each elevator car. The individual safety modules must always recognize and evaluate the car positions and speeds of the other participating elevator cars in order to be able to correctly react in an emergency case. A specific decision module is needed for that purpose, which in the emergency case is responsible for determining the stop commands.

A similarly complicated solution is known from International Patent Application WO 2004/043841 A1. According to this patent application infrared, laser or ultrasound sensors are arranged at each elevator car and measure the spacings from the adjacent elevator cars disposed above and below the elevator car. Furthermore, it is additionally proposed to use a shaft information system so that, for example, measuring strips arranged in the shaft can be scanned by sensors at the elevator cars in the form of light barriers. This electro-optical approach also makes it possible to control the spacing of the elevator cars and in a given case also the spacing from the shaft bottom and if needed to intervene in the control in order to prevent a collision.

The solution described in International Patent Application WO 2004/043841 A1 is, above all, complicated, because it obliges a communication between different opto-electronic components of the elevator cars so as to enable statements about the instantaneous state and the instantaneous speeds of the elevator cars.

Moreover, the described solutions are complicated to initialize when placing in operation, since all systems have to be matched to one another. The complexity of the systems makes these solutions possibly also susceptible to fault.

SUMMARY OF THE INVENTION

With consideration of the known arrangements a first object of the present invention is to provide a multi-mobile elevator installation which on approach between two elevator cars automatically stops the cars before collision without requiring a more complicated exchange of data between the elevator cars.

A further object of the present invention consists in preventing, in an elevator installation with at least one elevator car, an undesired approach of the car to or collision of the car with the shaft ends when the elevator car approaches the shaft ends.

Stated in other words, the objective is to improve the safety of elevator installations by simple and reliable means.

The present invention is just as suitable for preventing a collision between two elevator cars which relatively approach one another as for preventing collision between an elevator car and a shaft end. Equivalent variants of the safety equipment according to the invention or an elevator installation are described in the following.

In a first variant the safety equipment for an elevator installation with an upper elevator car and a lower elevator car, which are both movable substantially independently along a vertical direction in a common elevator shaft of the elevator installation, comprises a first electro-optical detection system with a first light source in a lower region of the upper elevator car and with a first detector. The first detector has a light-sensitive first sensor region in an upper region of the lower elevator car. The first light source issues a focused first light beam at a first angle with respect to the vertical direction. The first angle is so predetermined that on approach of the upper and the lower elevator cars the first light beam is incident on the first sensor region and thus is detectable by the first detector and the first detector triggers a reaction in order to prevent a collision of the elevator cars.

In addition, the safety equipment has a second electro-optical detection system with a second light source in an upper region of the lower elevator car and a second detector in a lower region of the upper elevator car.

With knowledge of the present invention the first variant can also be realized with more than two elevator cars movable substantially independently vertically in a common elevator shaft, wherein then at least one light source and a detector provided for this are present between each of these elevator cars.

In a second variant the safety equipment for an elevator installation with a lower shaft end and with at least one elevator car, which is movable substantially independently along a vertical direction in an elevator shaft of the elevator installation, comprises a first electro-optical detection system with a first light source in a lower region of the elevator car and with a first detector. The first detector has a light-sensitive first sensor region in the region of the lower shaft end. The first light source issues a focused first light beam at a first angle with respect to the vertical direction. The first angle is so predetermined that on approach of the elevator car to the lower shaft end the first light beam is incident on the first sensor region and thus is detectable by the first detector and the first detector triggers a reaction so as to prevent a collision of the elevator car.

In addition, the safety equipment comprises a second electro-optical detection system with a second light source in the region of the lower shaft end and a second detector in a lower region of the elevator car.

In a third variant the safety equipment for a elevator installation with an upper shaft end and with at least one elevator car, which is movable substantially independently along a vertical direction in an elevator shaft of the elevator installation, comprises a first electro-optical detection system with a first light source in the region of the upper shaft end and with a first detector. The first detector has a light-sensitive first sensor region in the upper region of the elevator car. The first light source issues a focused first light beam at a first angle with respect to the vertical direction. The first angle is so predetermined that on approach of the elevator car to the upper shaft end the first light beam is incident on the first sensor region and thus is detectable by the first detector and the first detector triggers a reaction in order to prevent a collision of the elevator car.

Moreover, the safety equipment comprises a second electro-optical detection system with a second light source in an upper region of the elevator car and a second detector in the region of the upper shaft end.

These variants can obviously also be advantageously combined, i.e. the elevator car of the second variant can be the lower of several elevator cars in a common elevator shaft of the elevator installation of the first variant, which both are movable substantially independently along a vertical direction in the elevator shaft.

Analogously, the elevator car of the third variant can be the upper of several elevator cars in a common elevator shaft of the elevator installation of the first variant, which both are movable substantially independently along a vertical direction in the elevator shaft.

Obviously, a combination of all three variants in one elevator installation is possible. Such a combination realizes a prevention of collisions of the two elevator cars with one another and with shaft ends.

An advantage of the present invention results from the simple arrangement of commercially available electro-optical components in order to prevent a collision of an elevator car in an elevator shaft. A further advantage lies in the automatic detection of the spacing by the detector and the triggering of an autonomous reaction on undesired approach of the elevator cars. Moreover, the detector in co-operation with a local computer unit is capable of triggering, with low computing cost, a collision-preventing reaction on the basis of speed data. Moreover, the redundant design of the safety equipment offers additional safety and enables an autonomous and rapid collision-preventing reaction of all elevator cars.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1A:
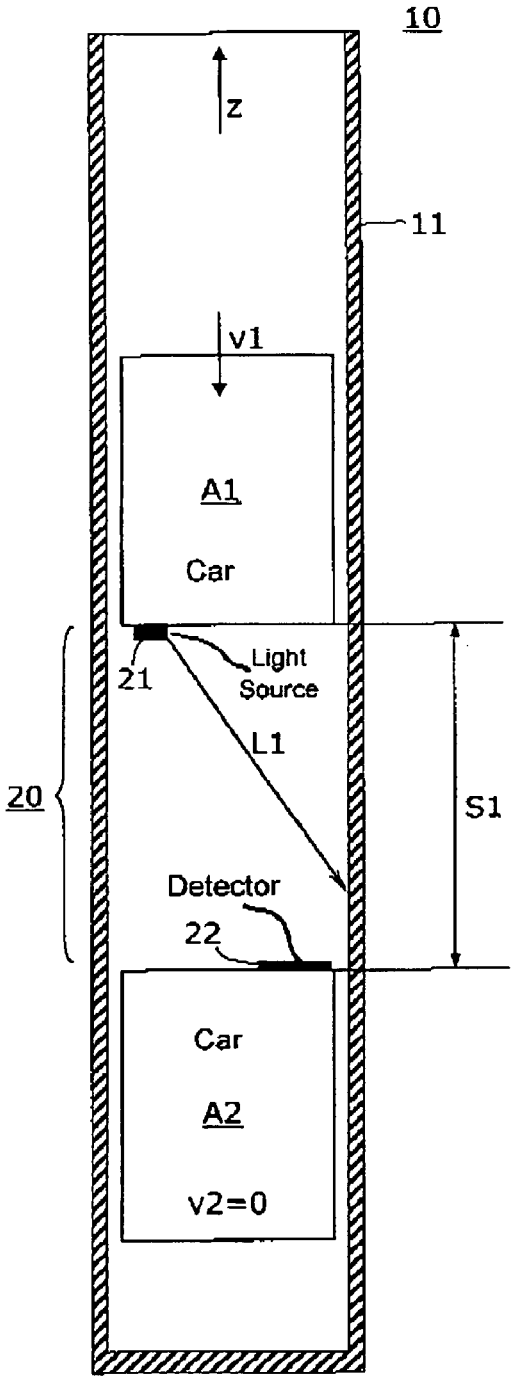
FIG. 1A is a schematic side view of a first multi-mobile elevator installation according to present the invention at a first point in time.
Figure 1B:
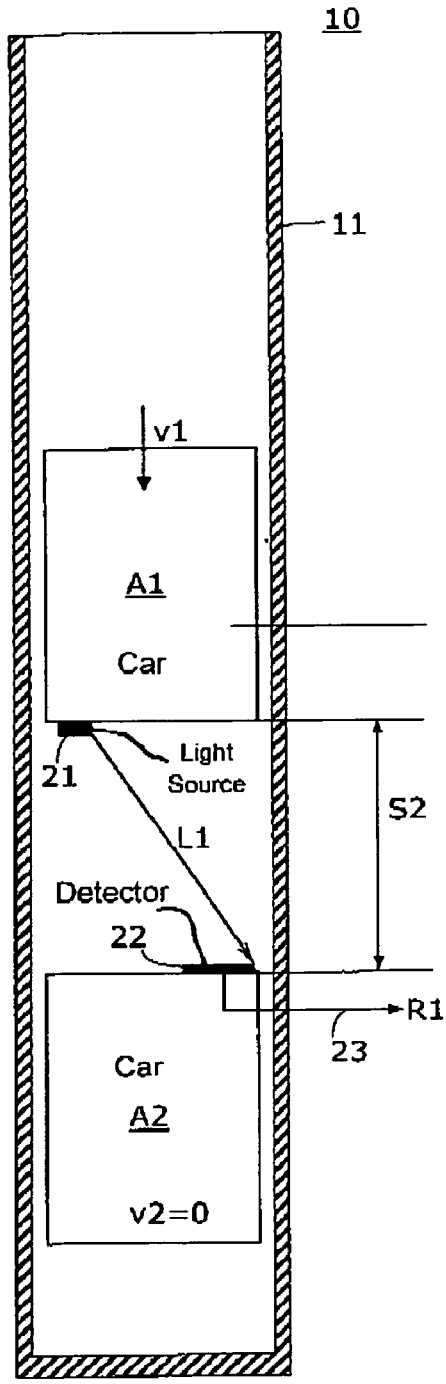
FIG. 1B is a schematic side view of the multi-mobile elevator installation according to FIG. 1A at a later point in time.

A first embodiment of the present invention is described in conjunction with the two snapshots in FIGS. 1A and 1B. A simple multi-mobile elevator installation 10 with an upper elevator car A1 and a lower elevator car A2, which two are movable substantially independently vertically in a common elevator shaft 11 of the elevator installation 10 along a vertical direction z, is shown. For this purpose the elevator cars A1, A2 can be provided with a drive and a holding brake per elevator car A1, A2 or, for example, can be individually coupled to a central drive system in order to enable individual movement in the elevator shaft 11. Beyond that, there are also other approaches in order to be able to individually move the elevator cars of a multi-mobile elevator installation.

Safety equipment is provided which comprises a first electro-optical detection system 20 with a first light source 21 arranged in a lower region of the upper elevator car A1, as schematically indicated in FIGS. 1A and 1B. Light-emitting diodes, which deliver focused light, are particularly suitable as light sources. Laser diodes or solid-body lasers are even more suitable.

In addition, the detection system 20 comprises a first detector 22 which comprises a light-sensitive first sensor region in an upper region of the upper elevator car A2. Photodiodes, phototransistors or other light-sensitive elements can be used as the sensor region 22.

The first light source 21 is so designed and arranged that it delivers a focused first light beam L1 at a first angle W1 with respect to the vertical direction z. In the illustrated example the light beam L1 is directed downwardly.

A snapshot (spacing between the cars amounts to S1) is shown in FIG. 1A, where the upper elevator car A1 moves downwardly at a speed v1 and the lower elevator car A2 is stationary (v2=0). At the illustrated instant the light beam L1 is incident anywhere above the lower elevator car A2 against a wall of the elevator shaft 11.

If the relative spacing of the two elevator cars A1 and A2 now reduces to a minimum spacing S2, as shown in FIG. 1B, then the light beam L1 is incident for the first time on the sensor region 22.

According to the present invention the first angle W1 is so predetermined or set that on approach of the upper and lower elevator cars A1, A2 the first light beam L1 is incident on the first sensor region 22 as soon as the minimum spacing S2 is reached. At this instant of incidence the light beam L1 is thus detectable by the first detector 22, 24 and this detector 22, 24 triggers a reaction R1 which, for example, is passed on by way of a line or connection 23 to a control or the like.

The present invention now allows different forms of realization or constructional stages of the safety equipment.

In the simplest form of realization a reaction can be triggered directly on the first occasion of incidence of the light beam L1 on the sensor region 22. In this case it is sufficient if the sensor region 22 has a size—in the sense of area extent—which allows it to ensure that notwithstanding fluctuations in the elevator installation 10 a secure detection of the light beam L1 by the detector 22, 24 is possible.

Figure 2:
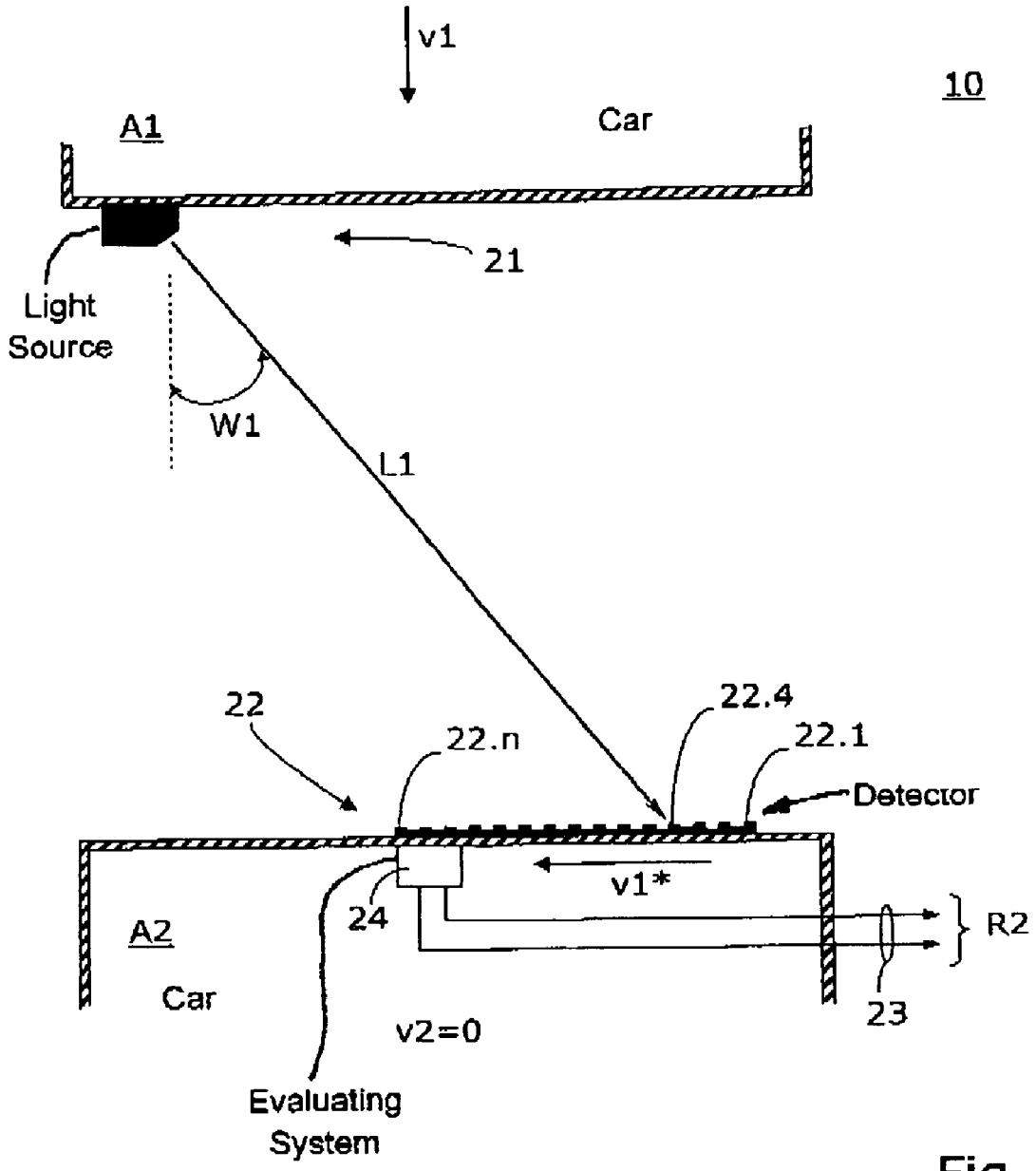
FIG. 2 is a schematic side view of a part of a second multi-mobile elevator installation according to the present invention.

A further form of realization of the present invention is indicated in FIG. 2. In this figure there is shown a snapshot shortly after the light beam L1 was detected the first time by a light-sensitive section 22.1 of the sensor region 22.

These sections are preferably able to be separately evaluated, i.e. they have respective individual electrical connections. For preference, with the different forms of embodiment there is provided an appropriate evaluating system 24 (or 24 and 28 in the case of FIG. 3) in order to be able to trigger a matched reaction (R1, R2, R3, R4) in dependence on the sections (22.1-22.*n*) on which the first light beam L1 is incident.

If now the same spacings as in FIGS. 1A and 1B are adopted then at the illustrated instant the spacing is less than S2.

Since the upper elevator car A1 continues to move forward at the speed v1 towards the lower car A2 the 'light spot' generated by the light beam L1 displaces to the left. The safety equipment can now be so designed, programmed or set that with the first incidence at the section 22.1 of the sensor region 22 a pre-warning is given as a reaction or the elevator installation 10 or elevator car A1 and/or A2 is transferred to a pre-warning mode. If the light spot now goes beyond a previously fixed further section 22.4 of the sensor region 22 a final reaction can be triggered (for example, an emergency stop by triggering the braking equipment or the safety brake of the upper and/or the lower elevator car A1, A2). This two-stage approach offers additional safety and thereby assists with avoidance of erroneous triggerings.

A further form of realization of the present invention is now explained by reference to FIG. 2. As indicated by an arrow below the sensor region 22, the light spot migrates to the left at a speed v1* when the relative spacing between the elevator cars A1, A2 reduces at a speed v1. This speed v1* allows computerized determination of the speed v1 with use of simple trigonometric formulations. If, for example, the angle W1 amounts to 45 degrees then v1=v1*, since tan 45=1. If the angle W1 is greater than 45 degrees, then v1* is also greater than v1. With smaller angles W1, v1* is less than v1, i.e. a form of speed step-down or slowing is achieved. The size of the sensor region 22 can be reduced by such a slowing, which can possibly be of advantage since the appropriate sensors are expensive.

Figure 3:
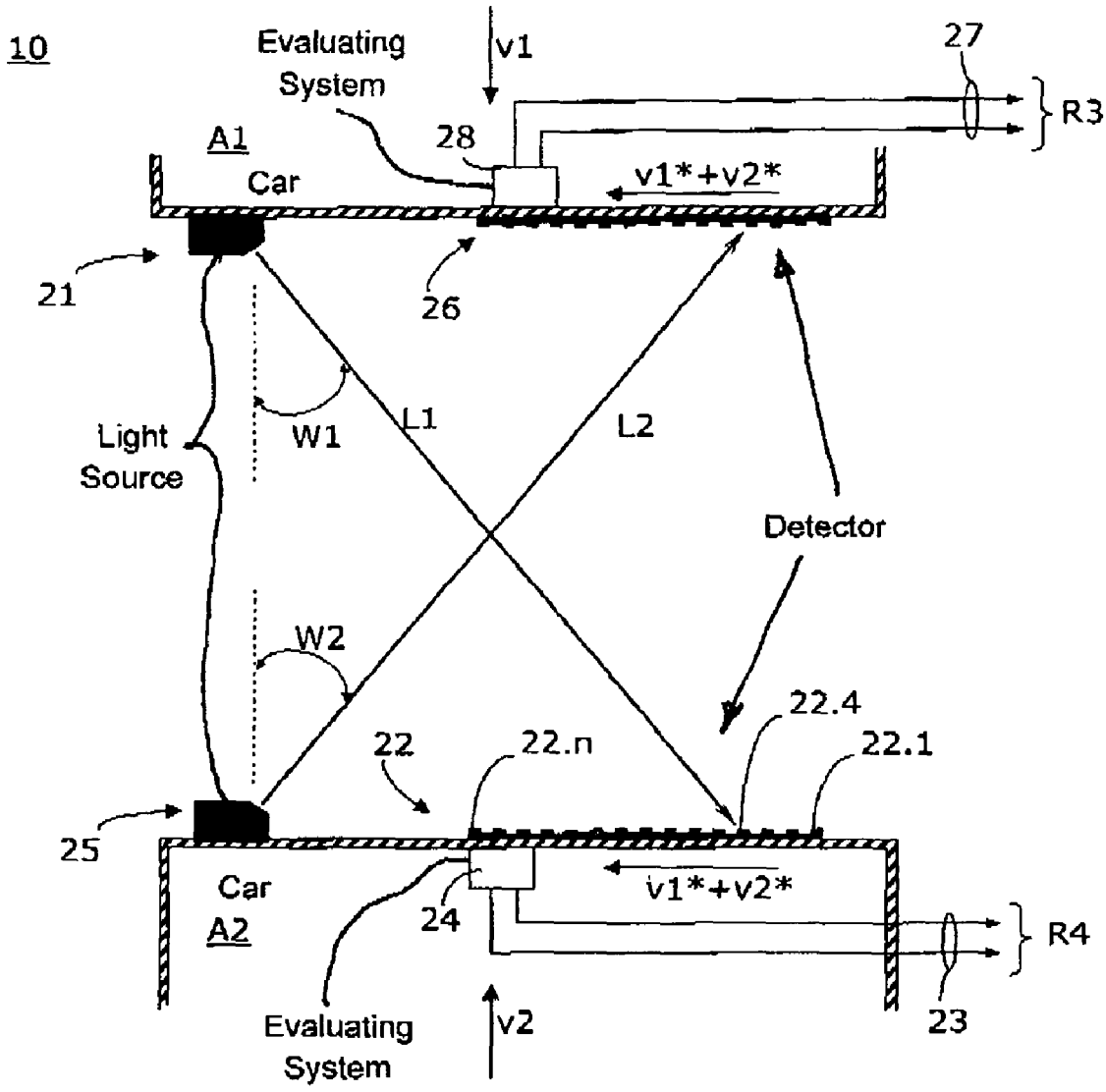
FIG. 3 shows a schematic side view of a part of a third multi-mobile elevator installation according to the present invention.

A further variant is shown in FIG. 3. This variant is currently preferred since it offers the greatest safety. Use is made, as shown, of two electro-optical detection systems. The first detection system is designed analogously to the system shown in the preceding figures. The second detection system can be constructionally identical, but is seated quasi in mirror image in the upper region of the lower elevator car A2. The corresponding second sensor region 26 is seated in the lower region of the upper elevator car A1.

In the illustrated example the two angles are the same, i.e. W1=W2. The angles can, however, also be predetermined or set to be different. In the case of identical execution of the electro-optical detection systems and if W1=W2, the two electro-optical detection systems transmit signals at the same time or trigger reactions R3, R4 at the same time.

It is schematically indicated in the figures that the detectors trigger respective reactions. The form of reactions differs depending on the respective form of embodiment, programming or setting of the devices. In the figures it is indicated that the detectors are in a position of issuing signals or data by way of lines or other connections 23 or 27. These signals or data are then either processed before reactions are triggered or they directly trigger the reactions, for example in that they open a switch which is part of a safety circuit.

There are numerous possibilities of managing the triggering of the reactions. The respective realization depends on various details of the respective elevator installation 10. If, for example, the elevator installation has an own safety circuit per elevator car A1, A2, the safety circuit of the upper and/or lower elevator car A1, A2 can be interrupted by the detector or detectors.

A multi-mobile elevator installation 10 preferably comprises an own safety circuit per elevator car A1, A2 in which several safety elements, such as, for example, safety contacts and safety switches, are arranged in a series circuit. The corresponding elevator car A1 or A2 can be moved only when the safety circuit and thus also all safety contacts integrated therein are closed. The safety circuit is connected with the drive or the brake unit of the elevator installation 10 in order to interrupt travel operation of the corresponding elevator car A1 or A2 if such a reaction is desired.

The present invention can, however, also be used in elevator installations which are equipped with a safety bus system instead of the mentioned safety circuit.

Alternatively or additionally to opening the safety circuits also the brakes of the respective elevator cars A1, A2 can be triggered.

Alternatively or additionally also possible safety brakes of the respective elevator cars A1, A2 can be triggered.

Thus, one or several of the following reactions can be triggered by the detectors 22, 24 or 26, 28 depending on the respective form of embodiment:

opening a safety circuit of at least one elevator car A1, A2, signal to an elevator control, triggering a braking device of at least one elevator car A1, A2, triggering a safety brake of at least one elevator car A1, A2, transferring at least one elevator car A1, A2 to a pre-warning state, adaptation of the vertical speed v1, v2 of at least one elevator car A1, A2.

Thus, a spacing control or a combined spacing and safety control can be realized by the present invention.

The angles W1, W2 can be set in a range of zero to 90° with respect to the vertical direction z. The angles W1, W2 preferably lie in the range between zero degrees and 60° degrees and, particularly preferably, between 10° and 50°.

Advantageously the angle W1, W2 is set to be variable in time in dependence on single or several parameters, such as the position, speed or acceleration of a elevator car A1, A2, the spacing, relative speed or relative acceleration of the elevator car A1, A2 relative to a reference point or the operational state of the elevator installation 10.

Thanks to the setting of the angle W1, W2 the angle W1, W2 can, for example, be set to be smaller in the case of a greater speed of the car A1, A2 so that the light beam L1, L2 is incident at an earlier point in time on the detector 22, 24 and this can thus trigger a reaction R1, R2, R3, R4 at an earlier point in time. With a lower speed, the necessity of an early reaction R1, R2, R3, R4 correspondingly reduces and thus a greater angle W1, W2 can be set. The connection between acceleration and angle behaves in analogous manner.

The operational state of the elevator installation 10, such as, for example, in the inspection or maintenance state, often presets a reduced maximum speed. Thus, in the case of an inspection travel of the elevator car A1, A2 the angle W1, W2 of the light beam L1, L2 can be increased after transfer of the elevator car A1, A2 to an inspection state, since the elevator car A1, A2 can be moved only at reduced speed.

The position of the elevator cars A1, A2 serves, for example, for the purpose of determining the time instant of a variable setting of the angle W1, W2. Accordingly, a critical spacing between the elevator cars A1, A2 or between an elevator car A1, A2 and the shaft end is defined. If this value is fallen below, the variable setting of the angle W1, W2 begins.

If several elevator cars travel in the same shaft 11, then corresponding safety equipment can also be provided between these elevator cars.

Moreover, corresponding sensor regions can also be provided at the lower and/or upper shaft end of the elevator shaft 11 so as to prevent a risk-laden approach of an elevator car to the respective shaft end. The operating principle is the same in this case as described in connection with the other forms of embodiment.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. Safety equipment for an elevator installation with an upper elevator car and a lower elevator car, which cars are both movable substantially independently along a vertical direction in a common elevator shaft of the elevator installation, wherein the safety equipment comprises:

a first electro-optical detection system with a first light source positioned in a lower region of the upper elevator car; and a first detector having a light-sensitive first sensor region positioned in an upper region of the lower elevator car, wherein said first light source issues a focused first light beam at a predetermined first angle with respect to the vertical direction so that on approach of the upper and the lower elevator cars said first light beam is incident on and detected by said first sensor region and said first detector triggers a reaction in response.

2. The safety equipment according to claim 1 including a second electro-optical detection system with a second light source positioned in an upper region of the lower elevator car and a second detector positioned in the lower region of the upper elevator car.

3. The safety equipment according to claim 1 wherein said first sensor region includes a plurality of several light-sensitive sections able to independently detect said first light beam.

4. The safety equipment according to claim 3 wherein said first detector includes an evaluating system for triggering a matched reaction in dependence on a one of said sections on which said first light beam is incident.

5. The safety equipment according to claim 1 wherein the reaction triggered by said first detector is at least one of opening a safety circuit of the elevator car, generating a signal to an elevator control, triggering a braking device of the elevator car, triggering a safety brake of the elevator car, transferring the elevator car to a pre-warning state, and adaptation of the vertical speed of the elevator car.

6. The safety equipment according to claim 1 wherein said first electro-optical detection system includes one of a spacing control and a combined spacing and speed control.

7. The safety equipment according to claim 1 wherein the predetermined first angle between said first light beam and the vertical direction is settable to be variable in time in dependence on at least one parameter.

8. The safety equipment according to claim 7 wherein the at least one parameter is one of a position, speed or acceleration of one of the elevator cars, a spacing between the elevator cars, a relative speed or a relative acceleration of one of the elevator cars with respect to a reference point, or an operational state of the elevator installation.

9. An elevator installation with the safety equipment according to claim 1 wherein at least one of the elevator cars has a drive and a holding brake and wherein a collision of the elevator cars can be prevented by the reaction.

10. Safety equipment for an elevator installation with an elevator shaft having at least one elevator car movable substantially independently along a vertical direction in the elevator shaft relative to an object in the shaft, the object being one of a lower shaft end, an upper shaft end and another elevator car, comprising:

a first electro-optical detection system with a first light source positioned on one of the at least one elevator car and the object; and a first detector with a light-sensitive first sensor region positioned on another one of the at least one elevator car and the object and facing said first light source, wherein said first light source issues a focused first light beam at a predetermined first angle with respect to the vertical direction and on approach of the at least one elevator car to the object said first light beam is incident on and detected by said first sensor region and said first detector triggers a reaction.

11. The safety equipment according to claim 10 including a second electro-optical detection system with a second light source positioned on the another one of the at least one elevator car and the object and a second detector with a light-sensitive second sensor region positioned on the one of the at least one elevator car and the object, wherein said second light source issues a focused second light beam at a predetermined second angle with respect to the vertical direction and on approach of the at least one elevator car to the object said second light beam is incident on and detected by said second sensor region and said second detector triggers a reaction.

12. The safety equipment according to claim 10 wherein the at least one elevator car is a lower one of at least two elevator cars in the elevator shaft and said object is an upper one of said at least two elevator cars, which said at least two elevator cars are movable substantially independently along the vertical direction in the elevator shaft.

13. The safety equipment according to claim 10 wherein the object is the lower shaft end.

14. The safety equipment according to claim 10 wherein the object is the upper shaft end.

15. Safety equipment for an elevator installation with an elevator shaft having at least one elevator car movable substantially independently along a vertical direction in the elevator shaft relative to first and second objects in the shaft, the first object being one of a lower shaft end of the elevator shaft and another elevator car and the second object being one of an upper shaft end of the elevator shaft and the another elevator car, comprising:

a first electro-optical detection system with a first light source positioned on one of a lower region of the at least one elevator car and the first object;

a first detector with a light-sensitive first sensor region positioned on another one of the lower region of the at least one elevator car and the first object facing said first light source, wherein said first light source issues a focused first light beam at a predetermined first angle with respect to the vertical direction and on approach of the at least one elevator car to the first object said first light beam is incident on and detected by said first sensor region and said first detector triggers a reaction;

a second electro-optical detection system with a second light source positioned on one of an upper region of the at least one elevator car and the second object; and a second detector with a light-sensitive second sensor region positioned on another one of the upper region of the at least one elevator car and the second object facing said second light source, wherein said second light source issues a focused second light beam at a predetermined second angle with respect to the vertical direction and on approach of the at least one elevator car to the second object said second light beam is incident on and detected by said second sensor region and said second detector triggers a reaction.

16. The safety equipment according to claim 15 wherein the first object is the lower shaft end and the second object is the upper shaft end.

17. The safety equipment according to claim 15 wherein the at least one elevator car is a lower one of at least two elevator cars in the elevator shaft, the first object is the lower shaft end, and the second object is an upper one of said at least two elevator cars, which said at least two elevator cars are movable substantially independently along the vertical direction in the elevator shaft.

18. The safety equipment according to claim 15 wherein the at least one elevator car is an upper one of at least two elevator cars in the elevator shaft, the first object is the upper shaft end, and the second object is a lower one of said at least two elevator cars, which said at least two elevator cars are movable substantially independently along the vertical direction in the elevator shaft.

19. The safety equipment according to claim 15 wherein said predetermined first and second angles are acute angles.

20. The safety equipment according to claim 1 wherein said predetermined first angle is an acute angle.

21. The safety equipment according to claim 11 wherein said predetermined first and second angles are acute angles.

* * * * *